US008319442B2

(12) United States Patent
Lin et al.

(10) Patent No.: US 8,319,442 B2
(45) Date of Patent: Nov. 27, 2012

(54) LED ARRAY CONTROL CIRCUIT WITH VOLTAGE ADJUSTMENT FUNCTION AND DRIVER CIRCUIT AND METHOD FOR THE SAME

(75) Inventors: Shui-Mu Lin, Taichung (TW); Ti-Ti Liu, Taipei (TW)

(73) Assignee: Richtek Technology Corporation, Hsin-Chu (TW)

( * ) Notice: Subject to any disclaimer, the term of this patent is extended or adjusted under 35 U.S.C. 154(b) by 304 days.

(21) Appl. No.: 12/800,845

(22) Filed: May 24, 2010

(65) Prior Publication Data

US 2011/0204797 A1 Aug. 25, 2011

(30) Foreign Application Priority Data

Feb. 25, 2010 (TW) ..... 99105489 A

(51) Int. Cl.
*H05B 37/00* (2006.01)

(52) U.S. Cl. ..... 315/185 R; 315/186; 315/192

(58) Field of Classification Search ..... 315/185 R, 315/186, 192, 291, 294, 297, 307, 312
See application file for complete search history.

(56) References Cited

U.S. PATENT DOCUMENTS

| | | | | |
|---|---|---|---|---|
| 7,843,150 | B2 * | 11/2010 | Wang et al. | 315/307 |
| 8,018,170 | B2 * | 9/2011 | Chen et al. | 315/192 |
| 8,169,156 | B2 * | 5/2012 | Hsu et al. | 315/291 |
| 2006/0256050 | A1 * | 11/2006 | Ikeda | 345/82 |
| 2009/0207109 | A1 * | 8/2009 | Wu et al. | 345/82 |
| 2011/0001434 | A1 * | 1/2011 | Hsu et al. | 315/186 |
| 2011/0084734 | A1 * | 4/2011 | Russell et al. | 327/108 |

* cited by examiner

*Primary Examiner* — Tung X Le
(74) *Attorney, Agent, or Firm* — Tung & Associates

(57) ABSTRACT

The present invention discloses an LED array control circuit with voltage adjustment function and a driver circuit and a method for the same. The LED array includes multiple LED strings each of which has multiple LED devices connected in series. The LED array control circuit includes: a power supply circuit for providing a supply voltage to the LED array; and an LED driver circuit for controlling current through each LED string, the LED driver circuit including: multiple current sources corresponding to the multiple LED strings respectively, each current source having a first end which is coupled to a corresponding LED string, and a second end; and a voltage adjustment circuit for adjusting a voltage of the second end of a corresponding current source according to a signal indicating a voltage drop across the corresponding LED string.

18 Claims, 11 Drawing Sheets

LED ARRAY CONTROL CIRCUIT WITH VOLTAGE ADJUSTMENT FUNCTION AND DRIVER CIRCUIT AND METHOD FOR THE SAME

CROSS REFERENCE TO RELATED APPLICATIONS

This application claims priority to Taiwanese Patent 099105489, filed on Feb. 25, 2010.

BACKGROUND OF THE INVENTION

1. Field of Invention

The present invention relates to a light emitting diode (LED) array control circuit, an LED driver circuit, and an LED array control method; particularly, it relates to an LED array control circuit with voltage adjustment function. The present invention also relates to an LED driver circuit and an LED array control method with voltage adjustment function.

2. Description of Related Art

LEDs are widely applied in many applications; as one example, LEDs arranged in an array are used to provide backlight to a liquid crystal display (LCD). Referring to FIG. 1A, for driving an LED array 20, an LED array control circuit 1 is required to provide a proper voltage and current to the LED array 20.

More specifically, as shown in FIG. 1A, the LED array control circuit 1 includes a first power supply circuit 10 which provides a supply voltage VLED to the LED array 20. The LED array 20 includes N LED strings, and each LED string has M LEDs, wherein M and N are positive integers. One end of each of the N LED strings is commonly coupled to the first power supply circuit 10, and the other end of each of the N LED strings is coupled to a corresponding one of N current sources 301. Each current source 301 controls the current through the corresponding LED string, such that as a whole the LED array generates uniform and consistent backlight. A schematic circuit diagram of the current source 301 is shown in FIG. 1B, wherein when the current source 301 operates normally, the current ILED provided by the current source 301 is balanced at ILED=Vref/R.

However, due to variation resulting from manufacture, the voltage across an LED may be different from one another with a variation up to 10%. In other words, a voltage drop across one LED string may be different from that across another LED string with a variation as high as 10%. For example, if each LED string includes 20 LEDs, in a worst case, the voltage variation between two LED strings may be as high as 6 volts. To ensure that all the current sources 301 operate normally, the supply voltage VLED must be high enough to support the LED string with the highest voltage drop, and therefore in the aforementioned example, there may be an excessive voltage up to 6 volts for some LED string(s) with a lower voltage drop. The excessive voltage will fall across the transistor of the corresponding current source, causing unnecessary power consumption and heat dissipation problems.

FIG. 2 shows another prior art, which is different from FIG. 1 in that the transistors and resistors of the current sources 301 are located outside of the chip 31. Nevertheless, the circuit of FIG. 2 operates in the same manner as the circuit of FIG. 1, and both have the same problems of unnecessary power consumption and heat dissipation.

In view of the foregoing, the present invention provides an LED array control circuit with voltage adjustment function to solve the foregoing problems; the present invention also provides an LED driver circuit and an LED array control method with voltage adjustment function.

SUMMARY OF THE INVENTION

The first objective of the present invention is to provide an LED array control circuit with voltage adjustment function.

The second objective of the present invention is to provide an LED driver circuit with voltage adjustment function.

The third objective of the present invention is to provide an LED array control method with voltage adjustment function.

To achieve the objectives mentioned above, from one perspective, the present invention provides an LED array control circuit with voltage adjustment function, for controlling an LED array which includes multiple LED strings, each LED string having multiple LED devices connected in series. Each LED string has a first end and a second end, and all the first ends are coupled to a common node. The LED array control circuit comprises: a first power supply circuit coupled to the common node for providing a supply voltage to the LED array; and an LED driver circuit for controlling current through each LED string. The LED driver circuit includes: multiple current sources corresponding to the multiple LED strings respectively, each current source having a first end and a second end, wherein the first end of each current source is coupled to the second end of a corresponding LED string; and a voltage adjustment circuit for adjusting a voltage of the second end of a corresponding current source according to a signal indicating a voltage drop across the corresponding LED string.

In one embodiment of the aforementioned LED array control circuit, the first power supply circuit provides a negative voltage.

The aforementioned LED array control circuit may further comprise a second power supply circuit coupled to the LED driver circuit, which provides at least one voltage as an option for the second end of the corresponding current source to be coupled to. The second power supply circuit for example includes one or a combination of more than one of: a buck switching regulator, a boost switching regulator, an inverter switching regulator, a buck-boost switching regulator, an inverter-boost switching regulator, a linear regulator, and a charge pump. The LED driver circuit may further include a charge pump which receives the voltage provided from the second power supply circuit and generates a different voltage as another option for the second end of the corresponding current source to be coupled to.

In the aforementioned LED array control circuit, the voltage adjustment circuit may include: one or more comparators for comparing the signal indicating the voltage drop across the corresponding LED string with one or more reference voltages and determining how to adjust the voltage of the second end of the corresponding current source thereby.

From another perspective, the present invention provides an LED driver circuit with voltage adjustment function, for controlling current through LEDs of an LED array; the LED array includes multiple LED strings, each LED string having multiple LED devices connected in series. Each LED string has a first end and a second end, and all the first ends are coupled to a power supply circuit. The LED driver circuit comprises: multiple current sources corresponding to the multiple LED strings respectively, each current source having a first end and a second end, wherein the first end of each current source is coupled to the second end of a corresponding LED string; and a voltage adjustment circuit for adjusting a voltage of the second end of a corresponding current source according to a signal indicating a voltage drop across the corresponding LED string. The signal indicating the voltage drop across the corresponding LED string is obtained for example from the second end of the corresponding LED string.

The aforementioned LED driver circuit may further comprise a charge pump which receives a voltage provided from external of the LED driver circuit and generates a different voltage as an option for the second end of the corresponding current source to be coupled to.

From another perspective, the present invention provides a method for controlling an LED array with voltage adjustment, comprising: providing an LED array which includes multiple LED strings; coupling each LED string with one end of a corresponding current source which controls current through the corresponding LED string; and adjusting a voltage of the other end of the corresponding current source according to a voltage drop across the corresponding LED string.

The aforementioned method for controlling an LED array may further comprise: providing a second power circuit electrically coupled to the LED driver circuit for providing at least one voltage for adjusting the voltage of the second end of the current source.

The objectives, technical details, features, and effects of the present invention will be better understood with regard to the detailed description of the embodiments below.

DESCRIPTION OF THE PREFERRED EMBODIMENTS

Figure 3:
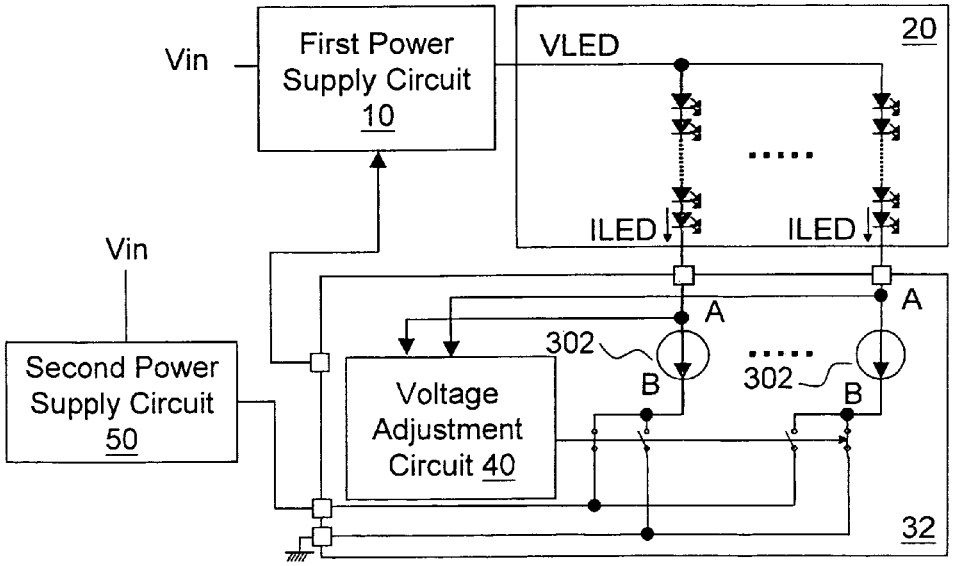
FIG. 3 illustrates a schematic circuit diagram of a first embodiment of the present invention.

FIG. 3 shows a first embodiment of the present invention. As shown in FIG. 3, a first power supply circuit 10 provides a supply voltage VLED to an LED array 20. The LED array 20 includes N LED strings, each of the LED strings having a first end and a second end. All the first ends of the N LED strings are coupled commonly to the first power supply circuit 10; the second end of each LED string is coupled to a first end (node A) of a corresponding one of N current sources 302 in an LED driver circuit 32. One feature of the present invention is that the second ends (nodes B) of the current sources 302 are not always coupled to ground; instead, they are coupled to an adjustable voltage level which is switchable among at least two different voltages. A second power supply circuit 50 provides a non-zero voltage (which may be a positive or a negative voltage, preferably negative), and a voltage adjustment circuit 40 provides a switching control signal to control a switch circuit, for connecting each second end (node B) of the respective current source 302 to ground or to the voltage provided by the second power supply circuit 50. The voltage adjustment circuit for example may determine where the corresponding node B should be coupled to according to the voltage of the respective node A. For example, in case the second power supply circuit 50 provides a negative voltage, for an LED string whose node A has a highest voltage among all nodes A of the N LED strings, the voltage adjustment circuit 40 electrically connects the node B of the corresponding current source 302 to ground, and for the other LED strings, the voltage adjustment circuit 40 determines to couple the corresponding nodes B to ground or to the negative voltage provided by the second power supply circuit 50 according to a voltage difference between the highest node A and the nodes A of the other LED strings respectively. Therefore, even the voltage drop of one LED string is different from another due to variation in LED manufacture, the present invention can reduce the voltage difference across the transistor in the current sources 302, and minimize unnecessary power consumption of the circuit. In this embodiment, the voltage adjustment circuit 40, the switch circuit, and the current sources 302 are integrated in the LED driver circuit 32 to form an integrated circuit chip. Certainly, if desired, all or a part of the second power supply circuit 50 can also be integrated in the LED driver circuit 32.

Figure 1A:
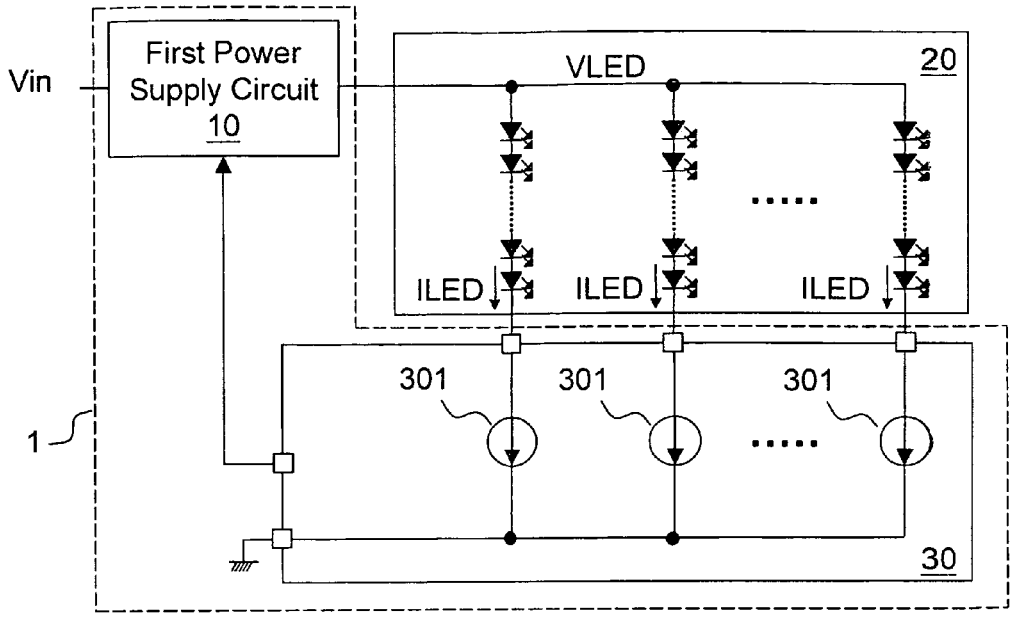
Fig. 1A (Prior Art)
FIG. 1A illustrates a schematic circuit diagram of a prior art LED control circuit.

Referring to FIG. 3 in conjunction with FIG. 1, assuming that among all the LED strings in the LED array 20 in FIG. 1, the highest voltage drop is 60 volts (therefore, the supply voltage VLED provided by the first power supply circuit 10 is 60 volts in FIG. 1), while the lowest voltage drop among the LED strings in the LED array 20 is 54 volts, according to the present invention, the second power supply circuit may provide a negative voltage of −6 volts, and thus the first power supply circuit 10 is only required to provide a supply voltage VLED of 54 volts; that is, in the present invention, the first power supply circuit 10 provides a voltage corresponding to the lowest voltage drop among the LED strings in the LED array, instead of the highest voltage drop among the LED strings, as in the prior art (under a condition that the second power supply circuit provides a negative voltage). Therefore, the present invention not only reduces the voltage difference across the transistor in the current sources 302, and minimizes unnecessary power consumption of the circuit, but also minimizes power consumption of the whole circuit if only one or a few of the LED strings require a relatively higher voltage.

The voltage provided by the second power supply circuit 50 is not limited to one voltage of −6 volts; it can be any other voltage or more than one voltage, such as 3.3% of the estimated highest voltage drop (−2 volts), 5% (−3 volts), 7.5% (−4.5 volts), or any other percentage of the estimated highest voltage drop. Obviously, if the LED driver circuit 32 is provided with more voltage options, it can cope with more voltage variation conditions of the LED strings. Such "more voltage options" may be generated by various ways, for example, from power supplies on a circuit board, or directly or indirectly from the second power supply circuit 50, etc. Embodiments related to more voltage options provided by the second power supply circuit 50 will be explained later.

Figure 1B:
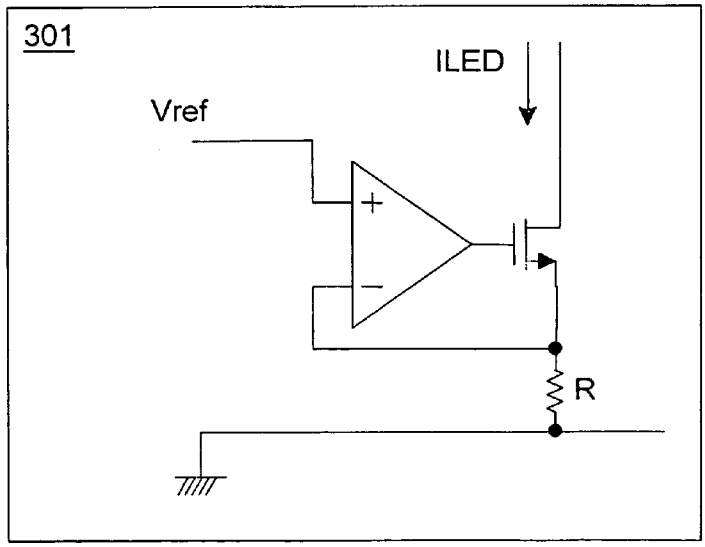
Fig. 1B (Prior Art)
FIG. 1B illustrates a schematic circuit diagram of a current source 301.
Figure 2:
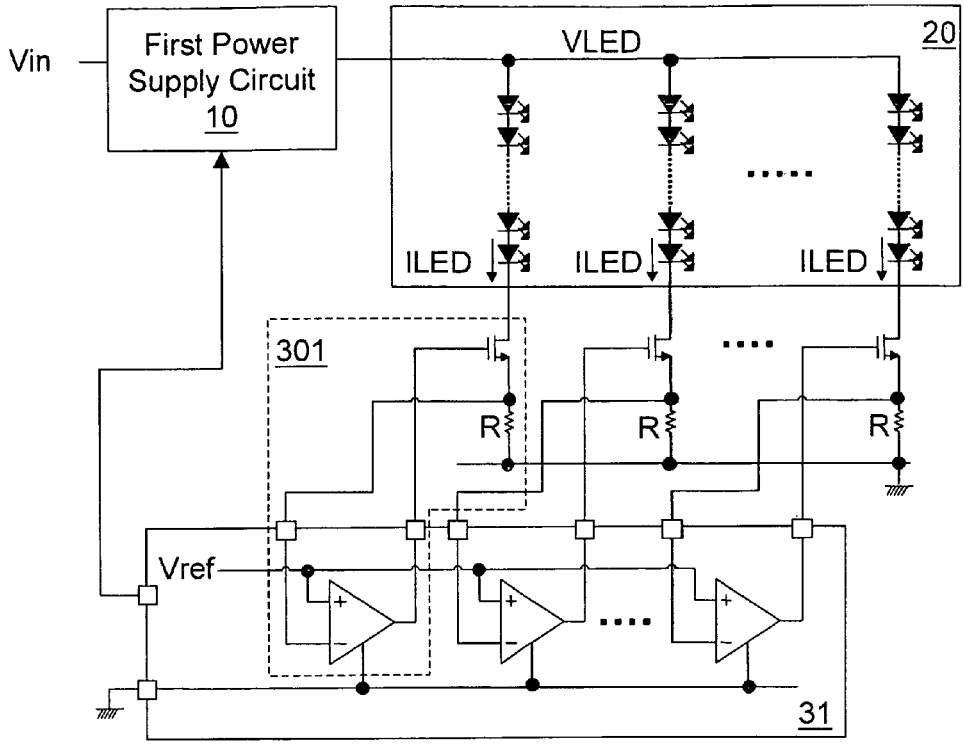
Fig. 2 (Prior Art)
FIG. 2 illustrates a schematic circuit diagram of another prior art LED control circuit.
Figure 3A:
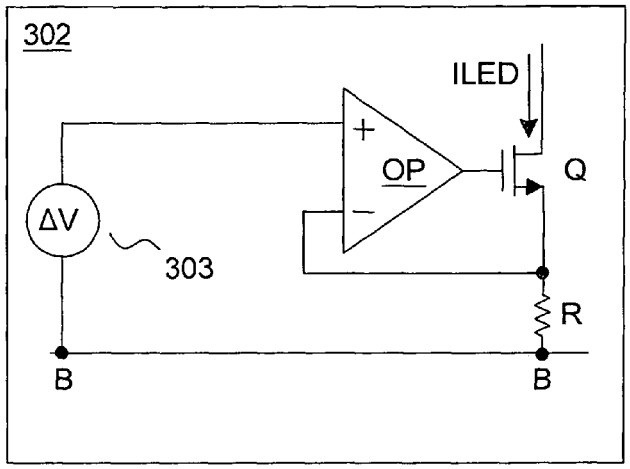
FIG. 3A illustrates a schematic circuit diagram of an embodiment of a DC current source 302.
Figure 3B:
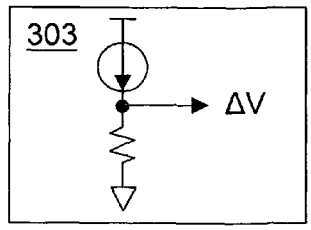
FIG. 3B shows an embodiment of a reference voltage ($\Delta V$) generator 303 formed by a current source and a resistor.

In the present invention, because the second end (node B) of the current source 302 is not always coupled to ground, the reference voltage in the current source 302 can not be the fixed reference voltage Vref in FIG. 1B. FIG. 3A illustrates a schematic circuit diagram of an embodiment of the current source 302. As shown in the figure, the current source 302 includes a transistor Q, a resistor R, an operational amplifier OP, and a reference voltage (ΔV) generator 303, wherein the reference voltage ΔV is a voltage superimposed on node B. The reference voltage generator 303 for example can be as shown in FIG. 3B, including a current source and a resistor. Different from the prior art current source 301, in the current source 302, the voltage inputted to the positive input terminal of the operational amplifier OP is the voltage at node B plus ΔV, instead of the fixed reference voltage Vref.

Figure 4:
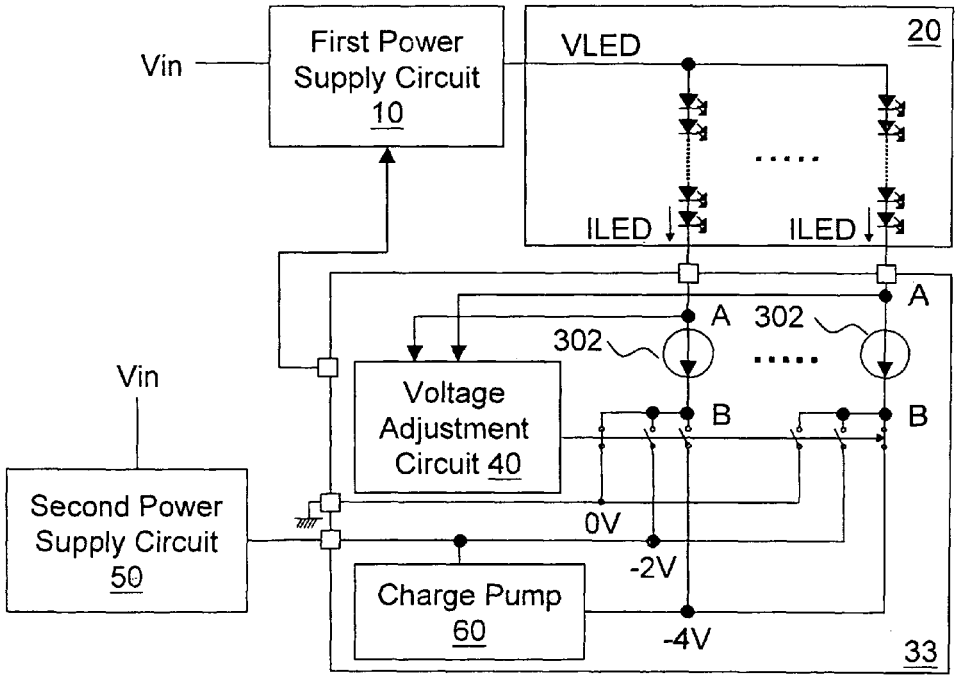
FIG. 4 illustrates a schematic circuit diagram of another embodiment of the present invention.

FIG. 4 shows another embodiment of the present invention. The difference between this embodiment and the first embodiment is that the LED driver circuit 33 further includes a charge pump 60, which uses a negative voltage (for example, −2 volts) provided by the second power supply circuit 50 to generate another negative voltage (for example, −4 volts), such that there is another voltage option for the second end of the corresponding current source to be coupled to. Certainly, the more charge pumps are provided, the more voltage options can be generated.

Figure 5:
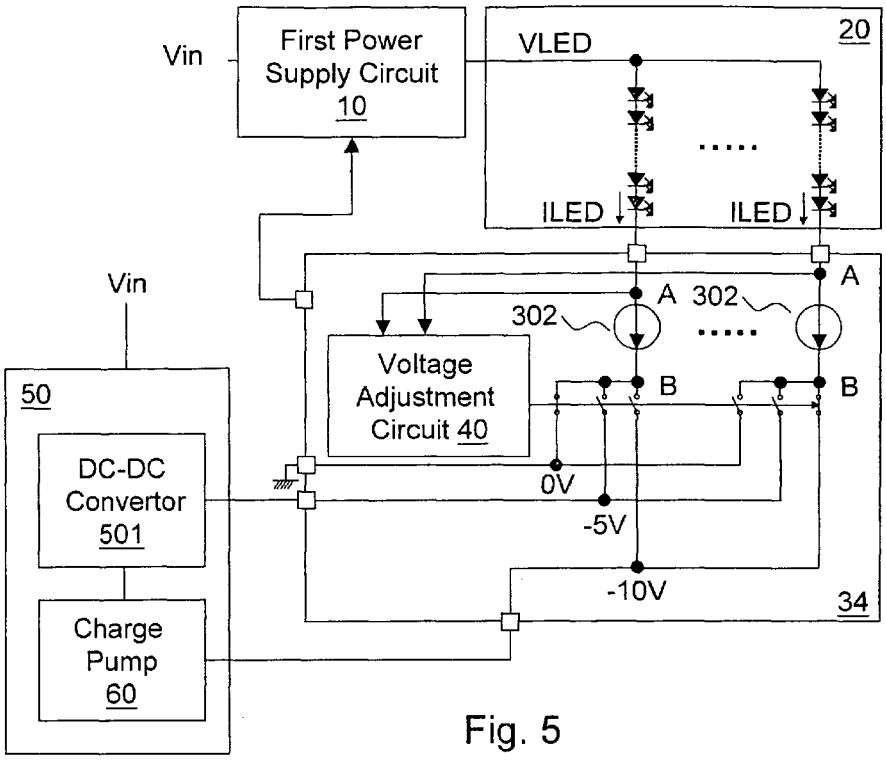
FIG. 5 illustrates a schematic circuit diagram of another embodiment of the present invention

FIG. 5 shows another embodiment of the present invention, wherein the second power supply circuit 50 generates and provides two or more voltage options (for example, −5 volts and −10 volts) to the LED driver circuit 34, instead of only one voltage in the previous embodiments. FIG. 5 shows one of the ways to provide two or more voltages. The second power supply circuit 50 for example may include a DC-DC convertor 51 and a charge pump 60, wherein the DC-DC converter 51 converts an input voltage Vin to a negative voltage of −5 volts, and the charge pump 60 converts the voltage of −5 volts to −10 volts.

Figure 5A:
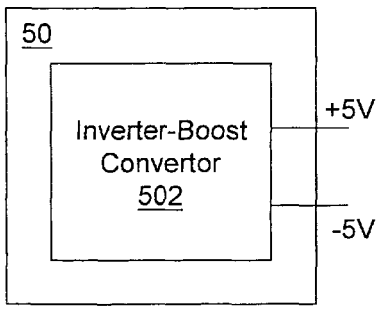
FIGS. 5A and 5B illustrate schematic circuit diagrams of two embodiments of a second power supply circuit 50.

FIG. 5A shows another embodiment of the second power supply circuit 50. The second power supply 50 includes an inverter-boost switching regulator 502 which provides both positive and negative voltages, such as a positive voltage of +5 volts and a negative voltage of −5 volts, as options for the current sources to be coupled to.

Figure 5B:
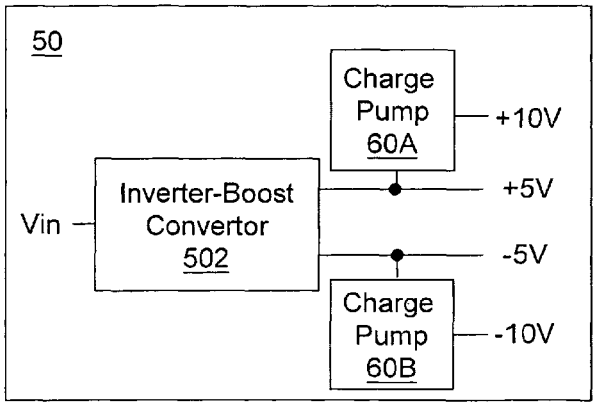

FIG. 5B shows yet another embodiment of the second power supply circuit 50. The second power supply 50 in this embodiment further includes two charge pumps 60A and 60B besides an inverter-boost switching regulator 502, for providing two positive voltages and two negative voltages, such as positive voltages of +5 and +10 volts and negative voltages of −5 and −10 volts.

In the aforementioned embodiments, the voltages such as +5 volts, +10 volts, −5 volts, −10 volts, etc. can be changed to any other voltages, with arbitrarily ratio relationships between the voltage options, and the positive and negative voltage options need not have the same absolute value. For example, four voltage options may be +2 volts, +5 volts, −3 volts, and −7 volts.

Figure 6:
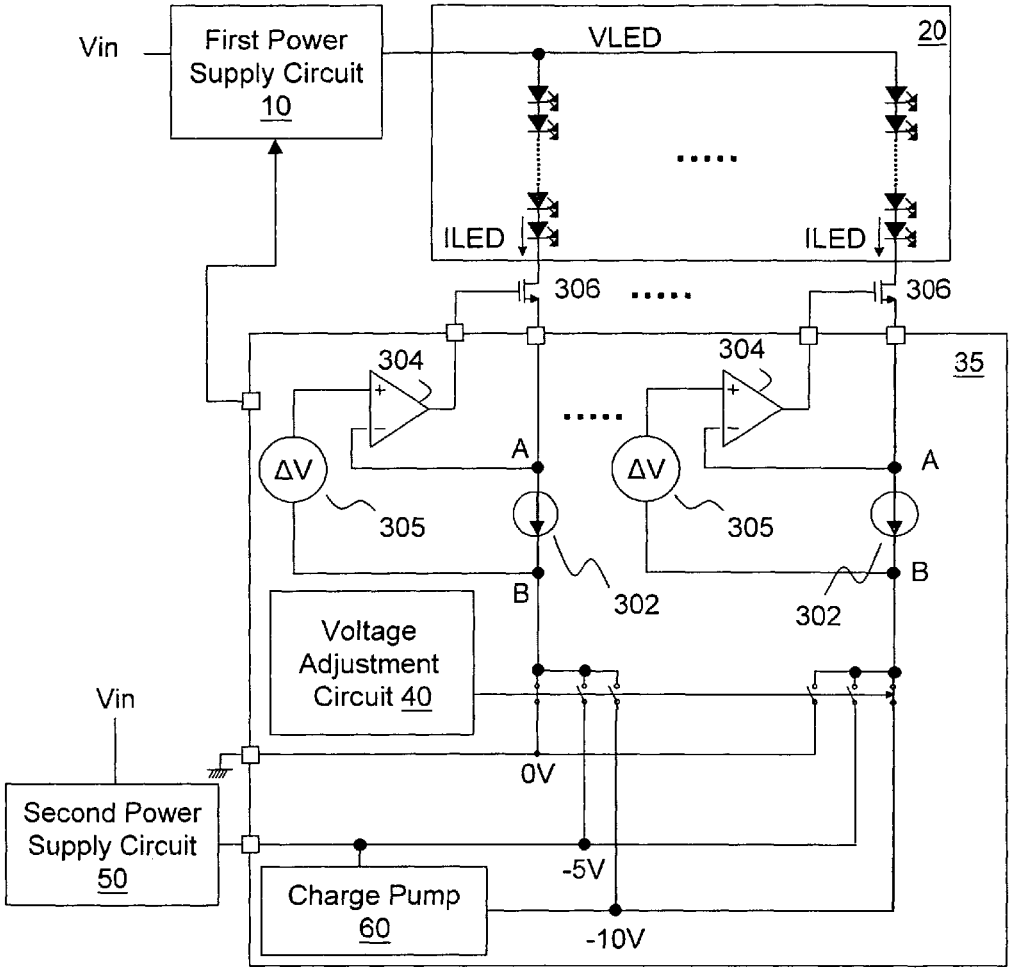
FIG. 6 illustrates a schematic circuit diagram of another embodiment of the present invention.

FIG. 6 shows another embodiment of the present invention. For a relatively larger supply voltage VLED, this embodiment further provides amplifiers 304, reference voltage (ΔV) generators 305, and transistors 306. The voltage difference between the two ends of the current source 302 (between node A and node B) is fixed to ΔV by the circuits 304-306 to ensure that the current source 302 operates normally. The transistor 306 is located external to the LED driver chip 35 (the LED driver is, for example, an integrated circuit chip). Thus, the transistor 306 can be a discrete device capable of enduring a relatively high voltage, while the integrated chip is isolated from high voltage, and therefore can be formed by low voltage devices.

Figure 7:
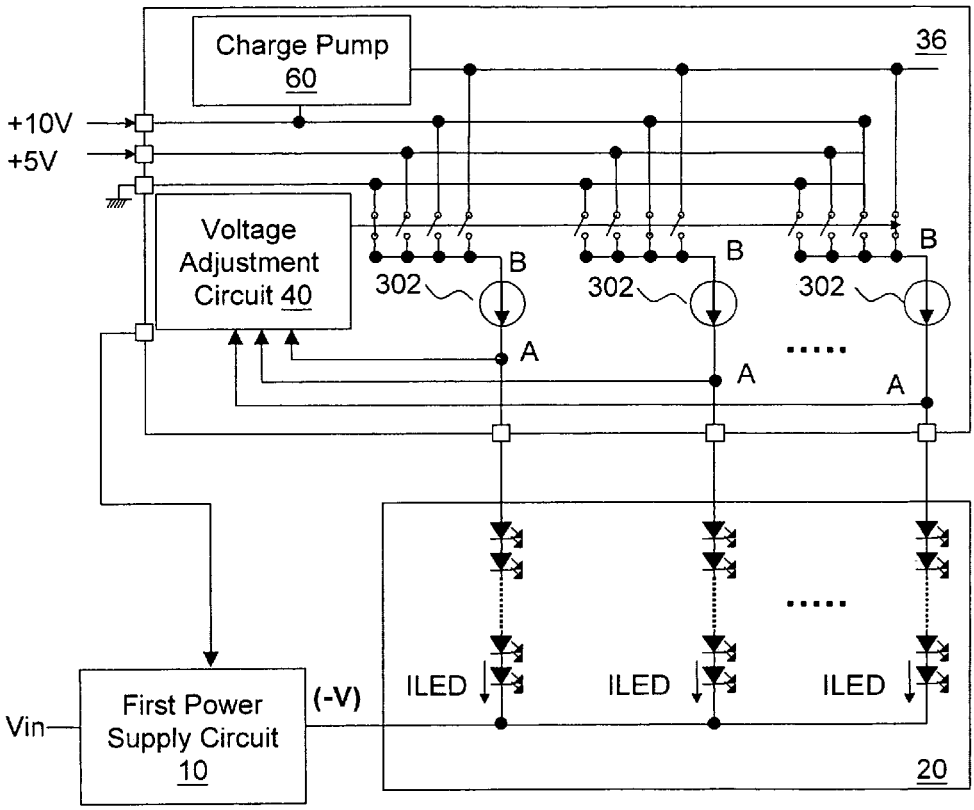
FIG. 7 illustrates a schematic circuit diagram of another embodiment of the present invention, wherein an LED array 20 is coupled to a first power supply circuit 10 and an LED control circuit 36 in a reverse structure.

FIG. 7 shows yet another embodiment of the present invention. As shown in the figure, this embodiment employs a "reverse" structure as compared to the previous embodiments. The first power supply circuit 10 provides a negative voltage to a first end (lower end in the figure) of each LED string, and the voltage adjustment options are positive voltages which can obtained directly from power supplies available on a circuit board, such as +5 volts and +10 volts, etc. Thus, a second power supply circuit is not necessarily required. The LED driver circuit 36 may further include a charge pump 60 to provide more voltage adjustment options, if required. Though the second power supply circuit is not necessary, certainly it can still be provided for generating more voltage options.

Figure 8:
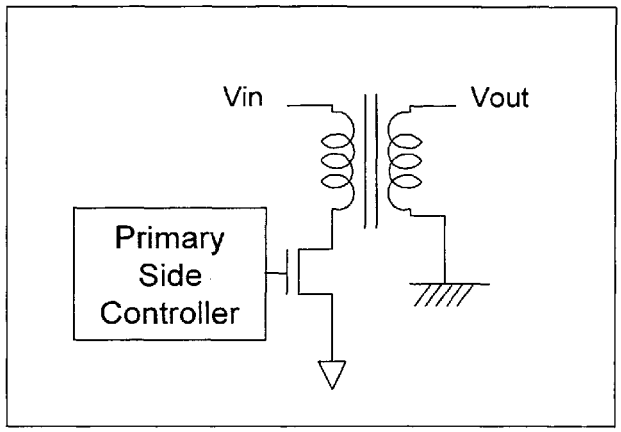
FIG. 8 is a schematic circuit diagram illustrating an example of an AC-DC convertor.
Figure 9A:
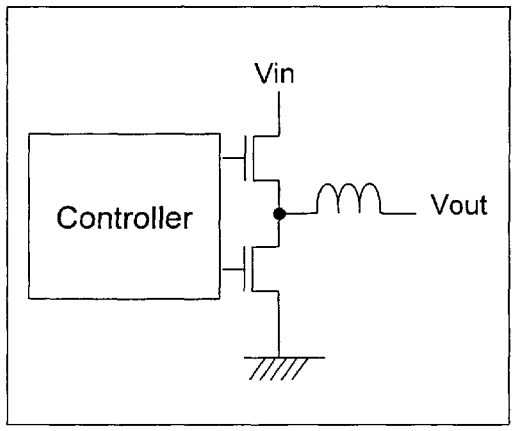
FIGS. 9A and 9B are schematic circuit diagrams illustrating examples of a buck switching regulator.
Figure 9B:
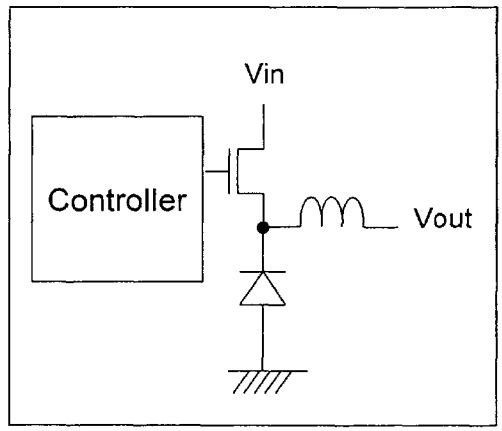
Figure 10A:
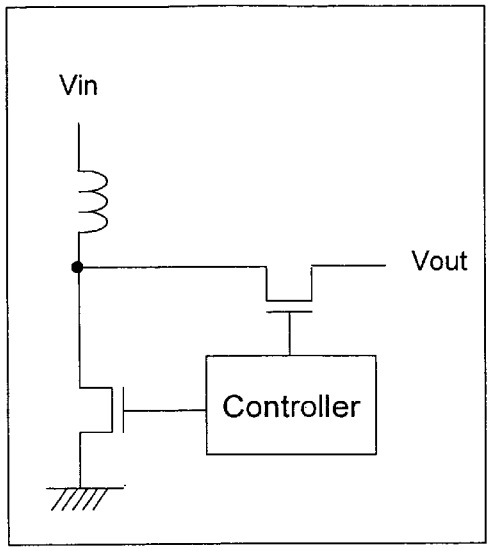
FIGS. 10A and 10B are schematic circuit diagrams illustrating examples of a boost switching regulator.
Figure 10B:
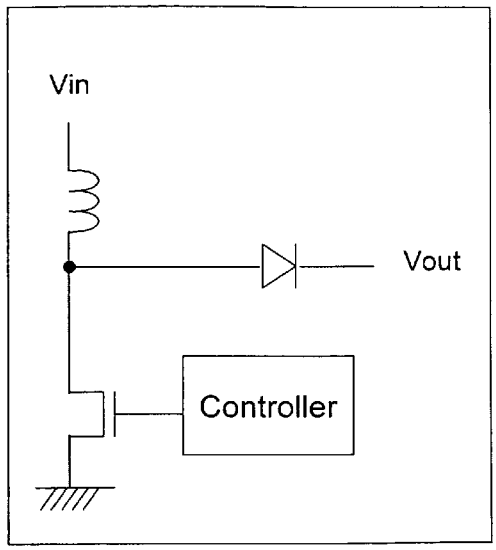
Figure 11A:
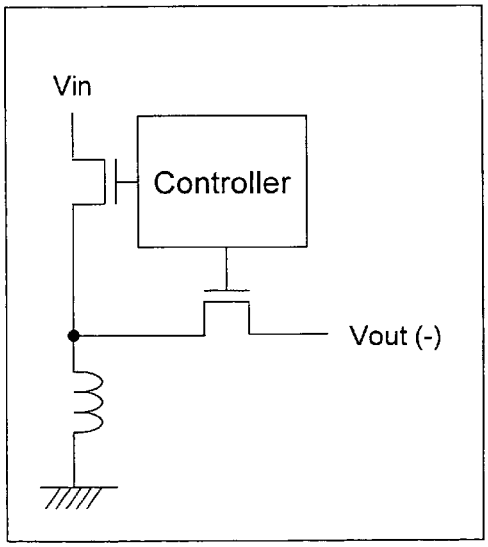
FIGS. 11A and 11B are schematic circuit diagrams illustrating examples of an inverter switching regulator.
Figure 11B:
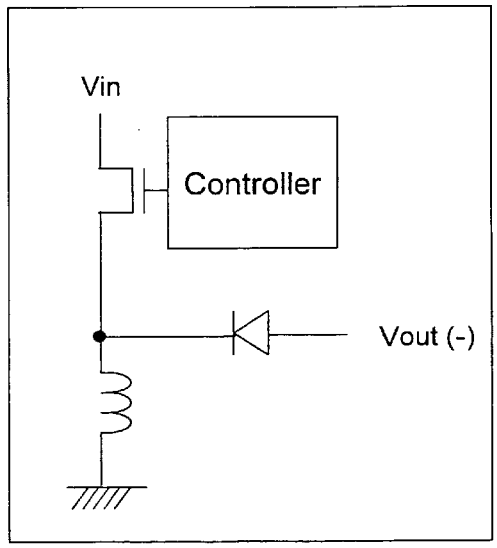
Figure 12A:
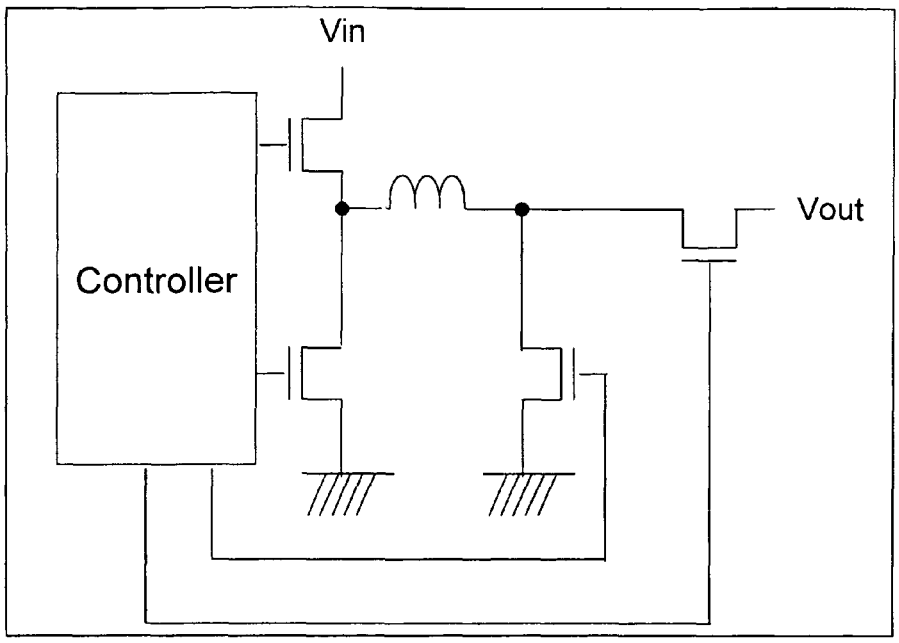
FIGS. 12A and 12B are schematic circuit diagrams illustrating examples of a buck-boost switching regulator.
Figure 12B:
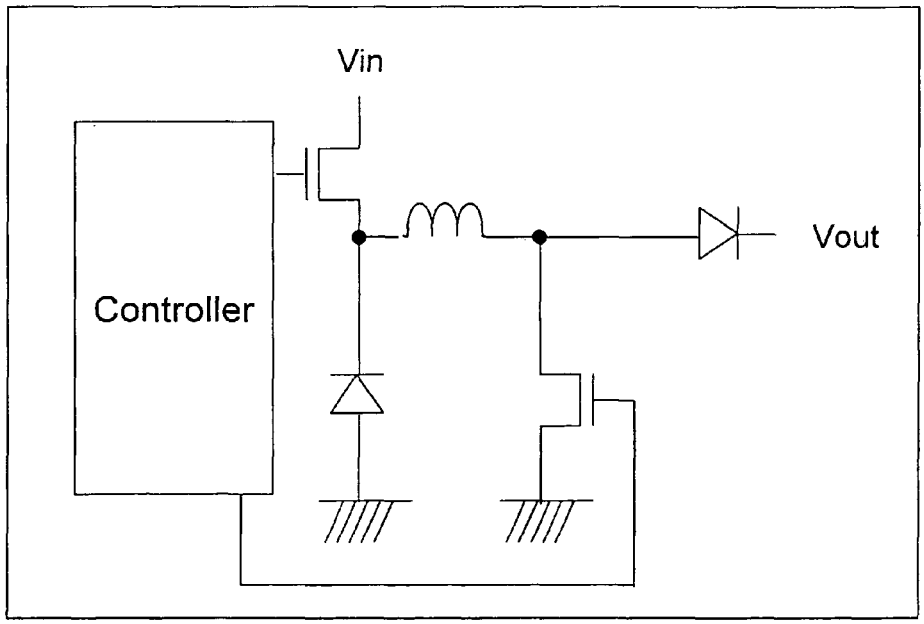
Figure 13A:
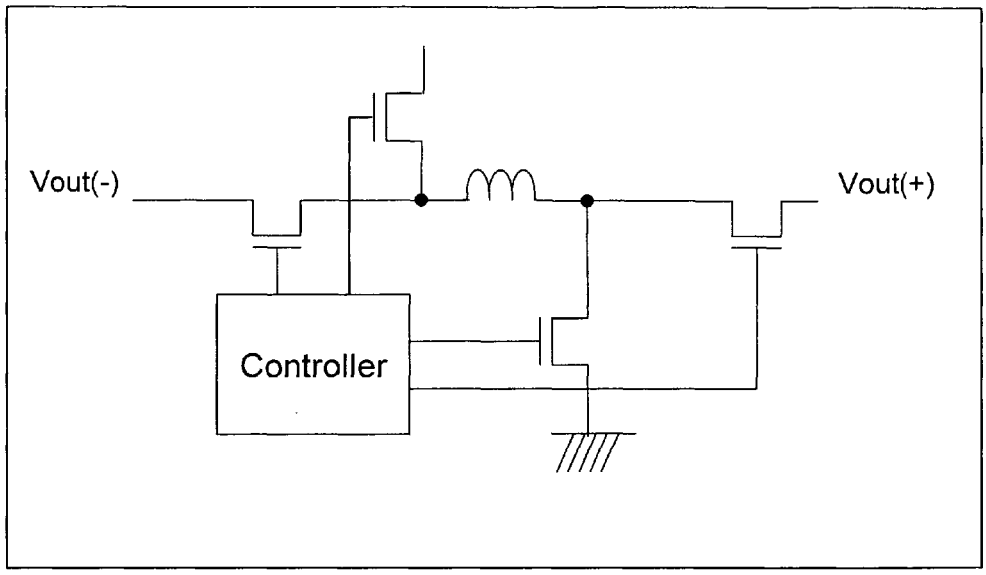
FIGS. 13A and 13B are schematic circuit diagrams illustrating examples of an inverter-boost switching regulator.
Figure 13B:
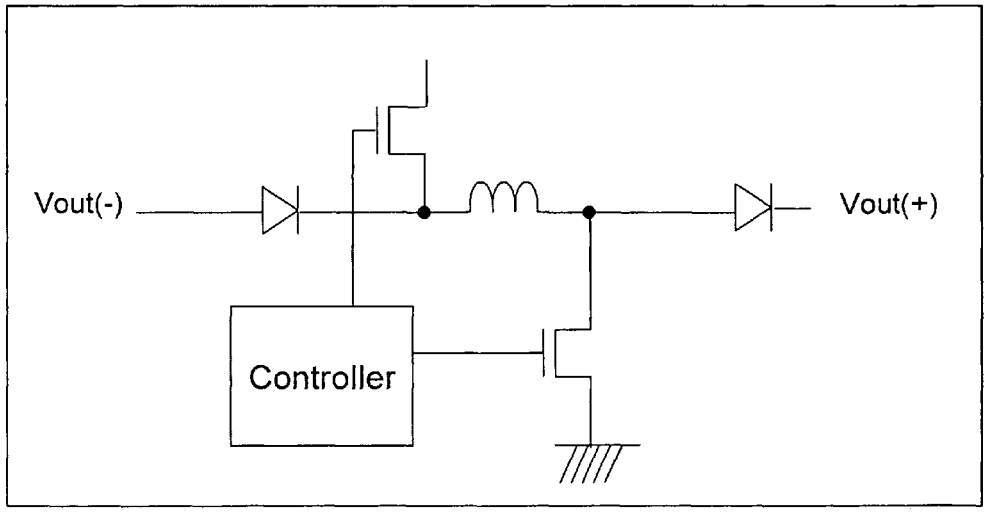
Figure 14:
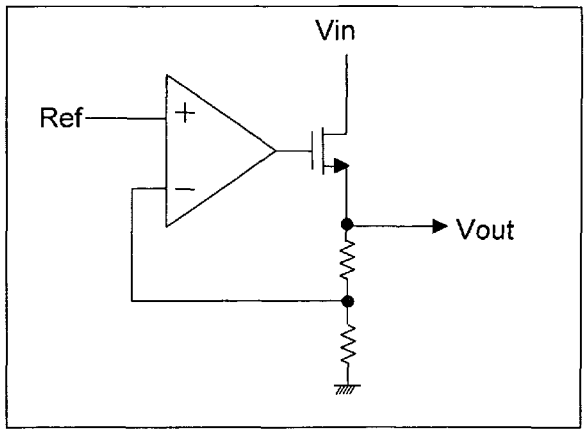
FIG. 14 is a schematic circuit diagram illustrating an example of a linear regulator.

In all the aforementioned embodiments, the first power supply circuit 10 for example may be one of the followings: an AC-DC converter, such as the one in FIG. 8, or a DC-DC converter, such as the buck switching regulators in FIGS. 9A and 9B, the boost switching regulators in FIGS. 10A and 10B, the inverter switching regulators in FIGS. 11A and 11B, the buck-boost switching regulators in FIGS. 12A and 12B, the inverter-boost switching regulators in FIGS. 13A and 13B, or the linear regulator in FIG. 14, etc.

The second power supply circuit 50 is preferably a DC-DC converter, such as: a charge pump, a circuit shown in anyone of FIGS. 9A-14, or any circuit shown in FIGS. 9A-14 plus at least one charge pump. The input voltage Vin to the second power supply circuit 50 may be the same or different from the input voltage Vin to the first power supply circuit 10. The DC-DC converter 501 for example may be anyone shown in FIGS. 9A-14. The inverter-boost switching regulator 502 for example may be either one shown in FIGS. 13A and 13B.

Figure 15:
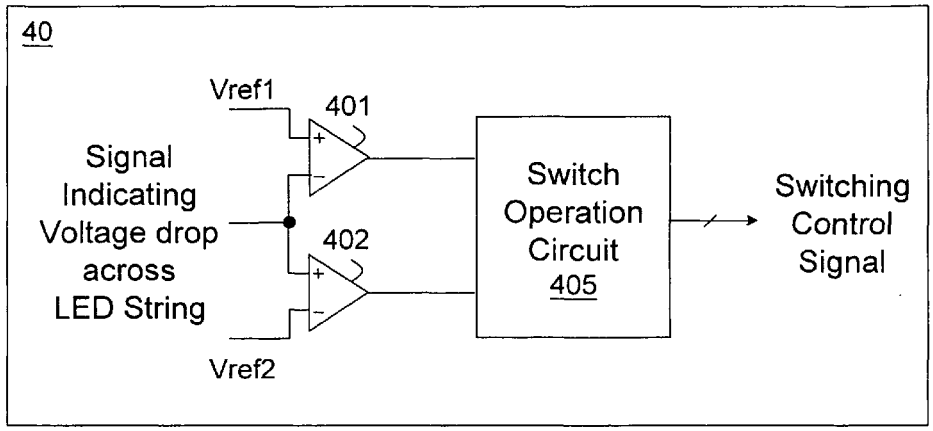
FIG. 15 illustrates, by way of example, an embodiment of a voltage adjustment circuit 40.

The voltage adjustment circuit 40 for example may be a circuit shown in FIG. 15. Assuming that three voltage adjustment options are required in the LED driver circuits 32-36 in the previous embodiments, the voltage adjustment circuit 40 is provided with two comparators 401 and 402 for each LED string. The comparators 401 and 402 compare a signal indicating the voltage drop across the corresponding LED string (such as the voltage at node A above the current source in FIGS. 3, 4 and 5, the drain voltage of the transistor 306 in FIG. 6, and the voltage at node A below the current source in FIG. 7) with reference voltages Vref1 and Vref2 respectively. A switch operation circuit 405 generates a switching control signal according to the comparisons by the comparators, to determine which voltage option should the second end of the current source 302 (node B) be coupled to. In the embodiments of FIGS. 3, 4, 5 and 6, when the indicating signal is higher than the reference voltage Vref1, indicating that the voltage drop of the corresponding LED string is relatively lower, the node B is determined to be coupled to a highest voltage option; when the indicating signal is lower than the reference voltage Vref1 but higher than the reference voltage Vref2, the node B is determined to be coupled to a second highest voltage option; when the indicating signal is lower than the reference voltage Vref2, the node B is determined to be coupled to a lowest voltage option. In the embodiments of FIG. 7, when the indicating signal is lower than the reference voltage Vref2, indicating that the voltage drop of the corresponding LED string is relatively lower, the node B is determined to be coupled to a lowest voltage option; when the indicating signal is higher than the reference voltage Vref2 but lower than the reference voltage Vref1, the node B is determined to be coupled to a second lowest voltage option; when the indicating signal is higher than the reference voltage Vref1, the node B is determined to be coupled to a highest voltage option.

In the aforementioned examples, it is assumed that the LED driver circuits 32-36 are provided with three adjustment voltage options. If only two options are provided, the voltage adjustment circuit 40 only requires one comparator, and the output of the comparator can be used to control the switches directly, so the switch operation circuit 405 is not required. On the other hand, if the LED driver circuits 32-36 are provided with four or more adjustment voltage options, the number of the comparators needs to be increased correspondingly.

The present invention has been described in considerable detail with reference to certain preferred embodiments thereof. It should be understood that the description is for illustrative purpose, not for limiting the scope of the present invention. Those skilled in this art can readily conceive variations and modifications within the spirit of the present invention. For example, a circuit or device which does not substantially influence the primary function can be inserted between any two circuits or two devices coupled directly in the shown embodiments; the indicating signal is not limited to be obtained from node A or the drain of the transistor 306; the switch circuit is not limited to the structure shown in the embodiments; the transistor of the current source can be replaced by a bipolar transistor; the charge pump is not limited to one which can generate only one output, but can be a charge pump which can generate multiple or switchable voltage outputs. In view of the foregoing, the spirit of the present invention should cover all such and other modifications and variations, which should be interpreted to fall within the scope of the following claims and their equivalents.

What is claimed is:

1. An LED array control circuit with voltage adjustment function, for controlling an LED array which includes multiple LED strings, each LED string having multiple LED devices connected in series; each LED string having a first end and a second end, and all the first ends being coupled to a common node, the LED array control circuit comprising:

a first power supply circuit coupled to the common node for providing a supply voltage to the LED array; and an LED driver circuit for controlling current through each LED string, the LED driver circuit including:

multiple current sources corresponding to the multiple LED strings respectively, each current source controlling an absolute value of a current through a corresponding LED string, and each current source having a first end and a second end, wherein the first end of each current source is coupled to the second end of a corresponding LED string; and a voltage adjustment circuit for adjusting a voltage of the second end of a corresponding current source according to a signal indicating a voltage drop across the corresponding LED string, such that when the supply voltage to the common node is a positive voltage, the voltage of the second end of the corresponding current source is switchable at least between a predetermined voltage and a negative voltage, and when the supply voltage to the common node is a negative voltage, the voltage of the second end of the corresponding current source is switchable at least between a predetermined voltage and a positive voltage.

2. The LED array control circuit of claim 1, further comprising:

a second power supply circuit coupled to the LED driver circuit, which provides at least one voltage as an option for the second end of the corresponding current source to be coupled to this at least one voltage provided by the second power supply circuit.

3. The LED array control circuit of claim 2, wherein the second power supply circuit includes one or a combination of more than one of: a buck switching regulator, a boost switching regulator, an inverter switching regulator, a buck-boost switching regulator, an inverter-boost switching regulator, a linear regulator, and a charge pump.

4. The LED array control circuit of claim 2, wherein the LED driver circuit further includes a charge pump which receives the voltage provided from the second power supply circuit and generates a different voltage as another option for the second end of the corresponding current source to be coupled to this different voltage generated by the charge pump.

5. The LED array control circuit of claim 1, wherein the signal indicating the voltage drop across the corresponding LED string is obtained from the second end of the corresponding LED string.

6. The LED array control circuit of claim 1, wherein the voltage adjustment circuit includes:

a comparator for comparing the signal indicating the voltage drop across the corresponding LED string with a reference voltage and determining how to adjust the voltage of the second end of the corresponding current source thereby.

7. The LED array control circuit of claim 1, wherein:

the LED driver circuit further includes multiple switches for selectively connecting the second end of the corresponding current source to a chosen voltage level; and the voltage adjustment circuit includes:

multiple comparators for comparing the signal indicating the voltage drop across the corresponding LED string with multiple reference voltages; and a switch operation circuit for controlling the multiple switches according to the comparison results of the multiple comparators.

8. The LED array control circuit of claim 1, wherein the first power supply circuit provides a negative voltage, and the second end of each current source is coupled to ground or a positive voltage.

9. An LED driver circuit with voltage adjustment function, for controlling current through LEDs of an LED array, the LED array including multiple LED strings, each LED string having multiple LED devices connected in series; each LED string having a first end and a second end, and all the first ends being coupled to a power supply circuit, the LED driver circuit comprising:

multiple current sources corresponding to the multiple LED strings respectively, each current source controlling an absolute value of a current through a corresponding LED string, and each current source having a first end and a second end, wherein the first end of each current source is coupled to the second end of a corresponding LED string; and a voltage adjustment circuit for adjusting a voltage of the second end of a corresponding current source according to a signal indicating a voltage drop across the corresponding LED string, such that when the supply voltage to the common node is a positive voltage, the voltage of the second end of the corresponding current source is switchable at least between a predetermined voltage and a negative voltage, and when the supply voltage to the common node is a negative voltage, the voltage of the second end of the corresponding current source is switchable at least between a predetermined voltage and a positive voltage.

10. The LED driver circuit of claim 9, further comprising a charge pump which receives a voltage provided from external of the LED driver circuit and generates a different voltage as an option for the second end of the corresponding current source to be coupled to this different voltage provided by the charge pump.

11. The LED driver circuit of claim 9, wherein the signal indicating the voltage drop across the corresponding LED string is obtained from the second end of the corresponding LED string.

12. The LED driver circuit of claim 9, wherein the power supply circuit provides a negative voltage, and the second end of each current source is coupled to ground or a positive voltage.

13. The LED driver circuit of claim 9, wherein the voltage adjustment circuit includes:

a comparator for comparing the signal indicating the voltage drop across the corresponding LED string with a reference voltage and determining how to adjust the voltage of the second end of the corresponding current source thereby.

14. The LED driver circuit of claim 9, further comprising:

multiple switches for selectively connecting the second end of the corresponding current source to a chosen voltage level; and wherein the voltage adjustment circuit includes:

multiple comparators for comparing the signal indicating the voltage drop across the corresponding LED string with multiple reference voltages; and a switch operation circuit for controlling the multiple switches according to comparison results of the multiple comparators.

15. The LED driver circuit of claim 9, wherein each current source includes:

a transistor;

a resistor having a first end coupled to one end of the transistor, and a second end coupled to a node; and an operational amplifier having an input terminal coupled to the first end of the resistor, another input terminal receiving a voltage which is equal to a voltage at the node plus a bias voltage, and an output controlling the transistor.

16. A method for controlling an LED array with voltage adjustment, comprising:

providing an LED array which includes multiple LED strings, wherein one end of the LED strings are connected to a common node receiving a common supply voltage;

coupling another end of each LED string with one end of a corresponding current source which controls an absolute value of a current through the corresponding LED string; and adjusting a voltage of the other end of the corresponding current source according to a voltage drop across the corresponding LED string, such that when the supply voltage to the common node is a positive voltage, the voltage of the second end of the corresponding current source is switchable at least between a redetermined voltage and a negative voltage and when the supply voltage to the common node is a negative voltage, the voltage of the second end of the corresponding current source is switchable at least between a predetermined voltage and a positive voltage.

17. The method of claim 16, further comprising:

providing at least one voltage other than ground, as an option for adjusting the voltage of the other end of the current source to this at least one voltage other than ground.

18. The method of claim 16, further comprising:

providing at least one positive voltage and one negative voltage as options for adjusting the voltage of the other end of the current source to one of the positive voltage and the negative voltage.

* * * * *